US007449273B2

(12) United States Patent
Ohki et al.

(10) Patent No.: US 7,449,273 B2
(45) Date of Patent: Nov. 11, 2008

(54) TONER CONTAINING UNSATURATED POLYESTER IN BINDER RESIN, METHOD FOR PREPARING THE TONER, AND DEVELOPER INCLUDING THE TONER

(75) Inventors: Masahiro Ohki, Numazu (JP); Naohiro Watanabe, Sunto-gun (JP); Ryota Inoue, Numazu (JP); Akinori Saitoh, Numazu (JP); Sonoh Matsuoka, Numazu (JP); Masahide Yamada, Numazu (JP); Chiaki Tanaka, Tagata-gun (JP)

(73) Assignee: Ricoh Company, Limited, Tokyo (JP)

( * ) Notice: Subject to any disclaimer, the term of this patent is extended or adjusted under 35 U.S.C. 154(b) by 295 days.

(21) Appl. No.: 11/196,602

(22) Filed: Aug. 4, 2005

(65) Prior Publication Data

US 2006/0046174 A1 Mar. 2, 2006

(30) Foreign Application Priority Data

Aug. 27, 2004 (JP) ..... 2004-248000

(51) Int. Cl.
*G03G 9/087* (2006.01)

(52) U.S. Cl. ..... 430/108.3; 430/108.4; 430/109.4; 430/137.15; 430/137.17; 430/137.21

(58) Field of Classification Search ..... 430/108.3, 430/108.4, 109.4, 110.1, 137.15, 137.17, 430/137.21

See application file for complete search history.

(56) References Cited

U.S. PATENT DOCUMENTS

| | | | | |
|---|---|---|---|---|
| 4,331,755 | A * | 5/1982 | Gilliams et al. | 430/109.4 |
| 4,814,253 | A * | 3/1989 | Gruber et al. | 430/110.1 |
| 5,472,819 | A * | 12/1995 | Hayashi et al. | 430/108.1 |
| 5,604,574 | A * | 2/1997 | Matsuura et al. | 430/110.1 |
| 6,319,647 | B1 * | 11/2001 | Gutman et al. | 430/109.4 |
| 6,326,119 | B1 * | 12/2001 | Hollenbaugh et al. | 430/109.4 |
| 6,365,316 | B1 * | 4/2002 | Stamp et al. | 430/109.4 |
| 6,475,688 | B1 * | 11/2002 | Tamura et al. | 430/108.3 |
| 6,787,280 | B2 | 9/2004 | Yamashita et al. | |
| 6,846,604 | B2 | 1/2005 | Emoto et al. | |
| 6,849,369 | B2 | 2/2005 | Yagi et al. | |
| 6,852,462 | B2 | 2/2005 | Emoto et al. | |
| 7,312,009 | B2 * | 12/2007 | Lee et al. | 430/108.3 |
| 2003/0180644 | A1 | 9/2003 | Nanya et al. | |
| 2004/0086797 | A1 * | 5/2004 | Kubo et al. | 430/109.4 |
| 2004/0131961 | A1 | 7/2004 | Watanabe et al. | |
| 2004/0157146 | A1 | 8/2004 | Tomita et al. | |
| 2005/0003291 | A1 | 1/2005 | Takada et al. | |
| 2005/0026066 | A1 | 2/2005 | Tanaka et al. | |
| 2005/0031980 | A1 | 2/2005 | Inoue et al. | |
| 2005/0042534 | A1 | 2/2005 | Tanaka et al. | |
| 2005/0164112 | A1 | 7/2005 | Ohki et al. | |
| 2006/0046174 | A1 | 3/2006 | Ohki, et al. | |

FOREIGN PATENT DOCUMENTS

| | | | |
|---|---|---|---|
| GB | 2091897 | A * | 8/1982 |
| JP | 63073269 | A * | 4/1988 |
| JP | 2537503 | | 7/1996 |
| JP | 2000-292973 | | 10/2000 |
| JP | 2000-292978 | | 10/2000 |

OTHER PUBLICATIONS

U.S. Appl. No. 11/685,969, filed Mar. 14, 2007, Uchinokura, et al.
U.S. Appl. No. 11/676,883, filed Feb. 20, 2007, Tanaka.
U.S. Appl. No. 11/687,075, filed Mar. 16, 2007, Yamada, et al.
U.S. Appl. No. 11/685,872, filed Mar. 14, 2007, Uchinokura, et al.
U.S. Appl. No. 11/687,372, filed Mar. 16, 2007, Yamada, et al.
U.S. Appl. No. 11/519,893, filed Sep. 13, 2006, Inoue, et al.
U.S. Appl. No. 11/513,175, filed Aug. 31, 2006, Ohki, et al.
U.S. Appl. No. 11/520,642, filed Sep. 14, 2006, Tanaka, et al.
U.S. Appl. No. 12/026,937, filed Feb. 6, 2008, Seshita, et al.
U.S. Appl. No. 11/852,778, filed Sep. 10, 2007, Nagatomo, et al.
U.S. Appl. No. 11/855,806, filed Sep. 14, 2007, Awamura, et al.
U.S. Appl. No. 11/856,379, filed Sep. 17, 2007, Sawada, et al.
U.S. Appl. No. 11/857,791, filed Sep. 19, 2007, Kojima, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 12/046,011, filed Mar. 11, 2008, Nagatomo, et al.

* cited by examiner

*Primary Examiner*—Christopher RoDee
(74) *Attorney, Agent, or Firm*—Oblon, Spivak, McClelland, Maier & Neustadt, P.C.

(57) ABSTRACT

A toner including a binder resin comprising a polyester resin in an amount of from 50 to 100% by weight, wherein the polyester resin includes an unsaturated polyester resin which is preferably a crystalline polyester resin; a colorant; and a fatty acid metal salt which is preferably microencapsulated. A method for preparing a toner including forming particles of a toner composition including at least a binder resin including a polyester resin in an amount of from 50 to 100% by weight and a colorant, in an aqueous medium to prepare a dispersion of a particulate material, wherein the polyester resin includes an unsaturated polyester resin; drying the particulate material; and mixing a fatty acid metal salt with the particulate material to subject double bonds of the unsaturated polyester resin to oxidation polymerization.

27 Claims, 1 Drawing Sheet

FIGURE
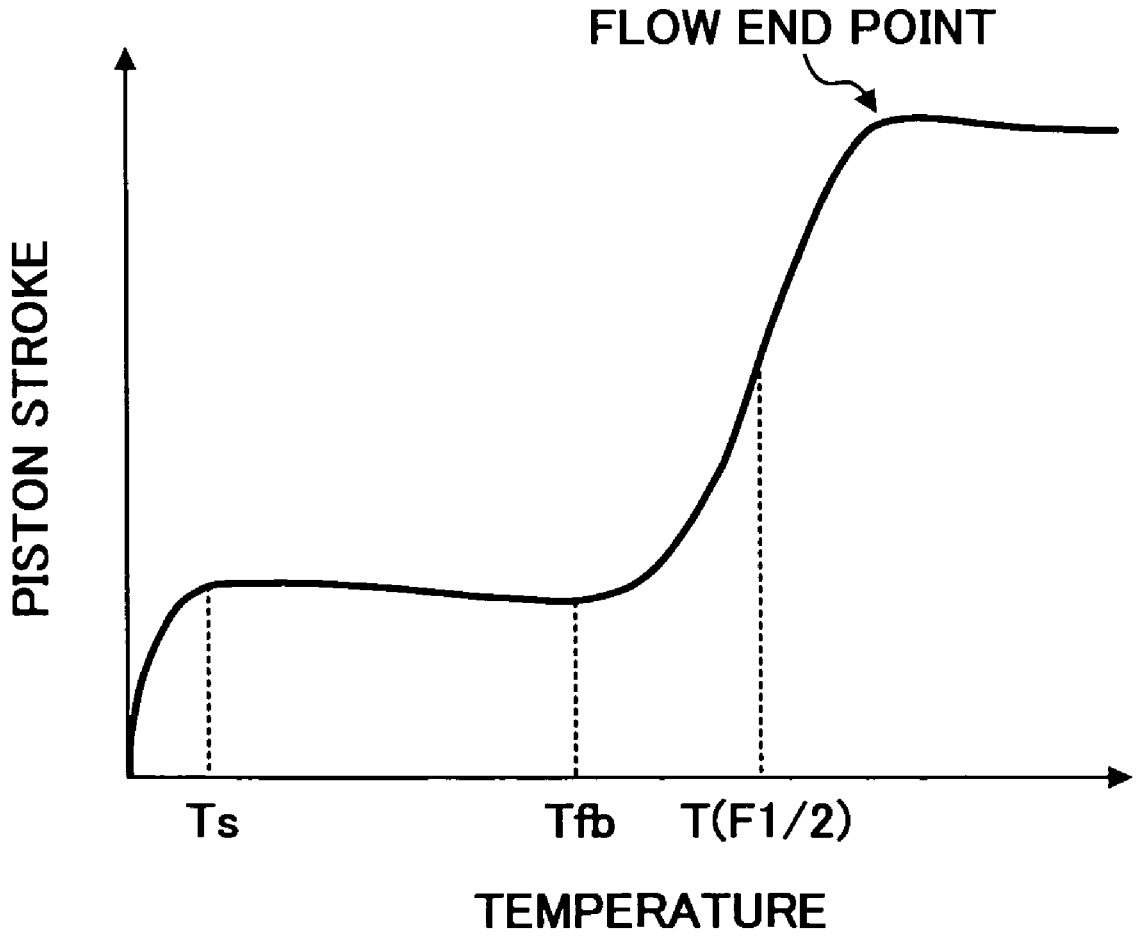

TONER CONTAINING UNSATURATED POLYESTER IN BINDER RESIN, METHOD FOR PREPARING THE TONER, AND DEVELOPER INCLUDING THE TONER

BACKGROUND OF THE INVENTION

1. Field of the Invention

The present invention relates to a toner for use in developing an electrostatic image. In addition, the present invention also relates to a method for preparing the toner, and to a developer including the toner.

2. Discussion of the Background

Image forming methods in which electrostatic images and magnetic images formed by electrophotographic image forming apparatus and electrostatic recording apparatus are developed with a developer including a toner to be visualized have been conventionally used. For example, electrophotographic image forming methods typically include the following processes:

(1) an electrostatic latent image is formed on an image bearing member (i.e.,. a photoreceptor);
(2) the electrostatic latent image is developed with a developer including a toner to from a toner image on the image bearing member;
(3) the toner image is transferred onto a receiving material via an intermediate transfer medium; and
(4) the toner image is fixed on the receiving material upon application of heat and/or pressure thereto.

Toner for use in developing electrostatic images are typically colored particles in which a colorant, a charge controlling agent and other additives are included in a binder resin or are present on a binder resin. Methods for preparing toner are broadly classified into pulverization methods and suspension polymerization methods.

The pulverization methods typically include the following processes:

(1) a colorant, a charge controlling agent, an offset preventing agent and other additives are kneaded with a melted thermoplastic resin serving as a binder resin to be uniformly dispersed therein;
(2) after being cooled, the kneaded mixture is pulverized; and
(3) the pulverized mixture is classified to prepare a toner.

The pulverization methods have an advantage in that the resultant toner has a combination of medium-level properties, but have a drawback that raw materials used for preparing the toner are limited. For example, the mixture prepared by melting and kneading toner constituents has to be pulverized and classified with conventional pulverizers and classifiers. Specifically, the kneaded mixture has to be brittle enough to be pulverized by conventional pulverizers. Therefore, when a kneaded mixture is pulverized, the resultant power tends to have a broad particle diameter distribution. In order to produce images with good resolution and half tone properties, the particle diameter of toner particles is preferably from 5 μm to 20 μm. Therefore, fine particles having a particle diameter less than 5 μm, and coarse particles having a particle diameter greater than 20 μm have to be removed from the resultant powder, resulting in serious decrease in yield of the toner in the classification process. In addition, it is difficult for the pulverization methods to uniformly disperse a colorant and a charge controlling agent in a thermoplastic resin (i.e., a binder resin). Uneven dispersion of such toner constituents adversely affects the fluidity, developability, durability and image qualities of the resultant toner.

In attempting to remedy the drawbacks of the pulverization methods, toner preparing methods using suspension polymerization have been proposed and practically used. It is well known to produce toner by polymerization methods. For example, a method in which a toner is prepared by a suspension polymerization method is used. However, toner prepared by such a suspension polymerization method has a poor cleanability. This is because the resultant toner particles have a spherical form. When images having a low image area proportion are formed using such a toner, a background development problem in that toner particles remaining on a photoreceptor without being removed therefrom in a cleaning process are transferred onto a non-image area of a receiving material, resulting in occurrence of background fouling is hardly caused. However, when images having a high image area proportion (such as pictorial images) are formed using such a toner or when a large amount of toner particles remain on a photoreceptor due to machine problems such as paper jamming, the background development problem is caused. In addition, another problem which occurs is that toner particles remaining on a photoreceptor even after a cleaning operation contaminate a contact charging roller which charges the photoreceptor-while contacting the photoreceptor, resulting in deterioration of charging ability of the charging roller.

In attempting to solve this problem, Japanese patent No. 2,537,503 discloses a method in which resin particles prepared by associating resin particles prepared by emulsion polymerization are used for a toner. However, toner particles prepared by emulsion polymerization methods include a large amount of surfactant therein and/or on the surface thereof even when the particles are fully washed. Therefore, the toner has drawbacks in that the charge quantity of the toner greatly changes depending on environmental conditions, and the toner has broad charge quantity distribution, thereby causing the background development problem. In addition, a problem in that the charging roller and developing roller used for an image forming apparatus together with the toner are contaminated with the surfactant remaining on the surface of the toner, resulting in deterioration of the charging ability of the charging roller and developing ability of the developing roller occurs.

When a release agent is further associated with particles prepared by such a method, the release agent is incorporated inside toner particles, and thereby good offset resistance cannot be imparted to the toner. Specifically, there is a case where the particulate resin, particulate release agent and particulate colorant are adhered to a portion of toner particles in a concentrated manner, or the materials are hardly adhered to a portion of toner particles. Therefore, a problem in that concentrations of toner constituents such as the resin, release agent and colorant in toner particles widely change occurs. Accordingly, it is impossible for the toner to stably produce good toner images for a long period of time. In addition, due to uneven distribution of the resin particles on the-surface of the toner particles, the toner has a high fixable temperature, namely, the toner has insufficient fixable temperature range.

On the other hand, toner used for contact heat fixing methods is required to have good releasability against heating members of the fixing devices used for fixing images of the toner (i.e., the toner is required to have a good offset resistance). The offset resistance of a toner is typically improved by a method in which a release agent is added to the toner so as to be present on a surface of the toner particles. In attempting to improve the offset resistance of a toner, published unexamined Japanese patent applications Nos. 2000-292973 and 2000-292978 disclose toners in which resin particles are not only included in toner particles but also unevenly distributed on the surface of the toner particles. However, as a result of the present inventors' study, the toner has a high fixable temperature, namely, the toner has insufficient low temperature fixability (i.e., poor energy-saving property).

Because of these reasons, a need exists for a toner having a good combination of cleanability, low temperature fixability, and offset resistance without contaminating image forming members such as charging members, developing members and fixing members.

SUMMARY OF THE INVENTION

Accordingly, an object of the present invention is to provide a toner having a good combination of cleanability, low temperature fixability, and offset resistance without contaminating image forming members such as charging members, developing members and fixing members.

Another object of the present invention is to provide a method for efficiently and stably preparing the toner.

Yet another object of the present invention is to provide a developer which can stably produce high quality toner images for a long period of time without contaminating image forming members such as charging members, developing members and fixing members.

Briefly these objects and other objects of the present invention as hereinafter will become more readily apparent can be attained by a toner including at least a binder resin, a colorant, and a fatty acid metal salt, wherein the binder resin includes a polyester resin in an amount of from 50 to 100% by weight and the polyester resin includes an unsaturated polyester resin.

The fatty acid metal salt preferably serves to accelerate the oxidation polymerization of double bonds of the unsaturated polyester resin when the toner is heated in a fixing process.

The unsaturated polyester resin is preferably a crystalline polyester resin, which preferably has a melting point T(F1/2) of from 65 to 140° C. and a glass transition temperature (Tg) of from 65 to 140° C. In addition, the crystalline polyester resin preferably has a molecular weight distribution such that o-dichlorobenzene-soluble components of the crystalline polyester have a weight average molecular weight (Mw) of from 1,000 to 30,000, a number average molecular weight (Mn) of from 500 to 6,000 and a ratio (Mw/Mn) of from 2 to 8, which are determined by gel permeation chromatography. In addition, it is preferable for the crystalline polyester resin to have an infrared absorption spectrum such that an absorption due to the δ CH (i.e., out-of-plane angle-changing vibration) of an olefin is observed at $965\pm10\ cm^{-1}$ or $990\pm10\ cm^{-1}$.

The crystalline polyester resin preferably has the following formula (1):

$$[—O—CO—(CR_1{=}CR_2)_L—CO—O—(CH_2)_n—]_m \quad (1),$$

wherein each of n and m is a repeat number and is a positive integer; L is an integer of from 1 to 3; and each of $R_1$ and $R_2$ represents a hydrogen atom, or a hydrocarbon group.

The crystalline polyester resin preferably has a unit obtained from a diol compound having from 2 to 6 carbon atoms (preferably, 1,4-butanediol, 1,6-hexanediol or a derivative thereof) and a unit obtained from an acid compound selected from the group consisting of fumaric acid and derivatives thereof.

The crystalline polyester resin preferably has an acid value of from 5 to 45 mgKOH/g and/or a hydroxyl value of from 5 to 50 mgKOH/g.

The polyester resin preferably includes a modified polyester resin (i), an unmodified polyester resin (ii) and the crystalline polyester resin (iii), wherein the weight ratio (i/(ii)+(iii)) is from 5/95 to 25/75 and a weight ratio (ii)/(iii) is from 99/1 to 50/50. In this case, each of the polyester resins (i) and (ii) preferably has an acid value of from 0.5 to 30 mgKOH/g. In addition, the unmodified polyester resin (ii) preferably has a glass transition temperature of from 30 to 70° C.

The fatty acid metal salt is preferably microencapsulated.

It is preferable for the toner to further include a release agent, preferably, in an amount of from 1 to 50 parts by weight per 100 parts by weight of the toner. The release agent preferably has a melting point of from 50 to 120° C.

As another aspect of the present invention, a method for preparing a toner is provided which includes:

forming particles of a toner composition including a binder resin including at least one polyester resin in an amount of from 50 to 100% by weight, and a colorant, in an aqueous medium to prepare a dispersion of a particulate material, wherein the at least one polyester resin includes an unsaturated polyester resin;

drying the particulate material; and mixing a fatty acid metal salt with the particulate material to subject double bonds of the unsaturated polyester resin to oxidation polymerization.

The unsaturated polyester resin is preferably a crystalline polyester resin.

The fatty acid metal salt is preferably microencapsulated.

The aqueous medium preferably includes a particulate resin, which preferably has an average particle diameter of from 5 to 500 nm.

The particle forming step preferably includes:

dispersing or dissolving a colorant in a binder resin including a polyester resin having a group reactive with an active hydrogen atom to prepare a toner composition liquid;

dispersing the toner composition liquid in an aqueous medium; and polymerizing the polyester resin to prepare the particles.

Alternatively, the particle forming step preferably includes:

dispersing or dissolving a binder resin and a colorant in an organic solvent to prepare a toner composition liquid;

dispersing the toner composition liquid in an aqueous medium to prepare an emulsion;

removing the organic solvent from the emulsion to prepare a dispersion of a particulate material In this case, the weight ratio of the colorant to the organic solvent is preferably from 5/95 to 50/50.

Alternatively, the particle forming step includes:

dispersing or dissolving at least a polymer having a group reactive with an active hydrogen atom, a colorant and a release agent in an organic solvent to prepare a toner composition liquid;

dispersing the toner composition liquid in an aqueous medium to prepare an emulsion;

removing the organic solvent from the emulsion after or while reacting the polymer with a compound having an active hydrogen atom to prepare a particulate material; and washing the particulate material.

The first mentioned dispersing step preferably includes:

dispersing or dissolving at least a modified polyester resin (i) having a group reactive with an active hydrogen atom, an unmodified polyester resin (ii), a crystalline polyester resin (iii), a colorant and a release agent in an organic solvent to prepare a toner composition liquid, wherein the weight ratio (i)/(ii)+(iii)) of the weight of the resin (i) to the total weight of the resins (ii) and (iii) is from 5/95 to 25/75 and wherein the weight ratio ((ii)/(iii)) of the resin (ii) to the resin (iii) is from 99/1 to 50/50.

Each of the resins (i) and (ii) has an acid value of from 0.5 to 30 mgKOH/g. The unmodified polyester resin (ii) preferably has a glass transition temperature (Tg) of from 30 to 70° C.

The aqueous medium preferably includes a particulate resin which preferably has an average particle diameter of from 5 to 500 nm.

As yet another aspect of the present invention, a developer is provided which includes the toner mentioned above and a carrier.

These and other objects, features and advantages of the present invention will become apparent upon consideration of the following description of the preferred embodiments of the present invention taken in conjunction with the accompanying drawing.

BRIEF DESCRIPTION OF THE DRAWING

FIGURE is a graph illustrating the thermal property of a resin, which is measured with a flow tester, for explaining the softening point ($T_s$), the flow starting point ($T_{fb}$) and the melting point T(F1/2) of the resin.

DETAILED DESCRIPTION OF THE INVENTION

The toner includes a polyester resin as a binder resin. The polyester resin is preferably a crystalline unsaturated polyester resin. By using such a crystalline unsaturated polyester resin as a binder resin, good low temperature fixability can be imparted to the toner. It is preferable for the toner to include a crystalline unsaturated polyester resin in an amount of from 0.5 to 50% by weight based on the total weight of the polyester resin included in the toner.

Resins other than polyester resins can be included in the toner in an amount of not greater than 20% by weight based on the total weight of the binder resin.

Specific examples of the other resins include homopolymers of styrene and styrene derivatives such as polystyrene, poly-p-chlorostyrene and polyvinyltoluene; copolymers of styrene and styrene derivatives such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, and aromatic petroleum resins; etc.

Suitable polyester resins for use in the toner of the present invention other than the unsaturated polyester resins include modified polyester resins, which have a group reactive with an active hydrogen atom. The modified polyester resin is preferably crosslinked and/or extended (i.e., the molecular chain thereof is extended) by being reacted with a compound having an active hydrogen atom such as amines. Further, the polyester resin preferably includes an unmodified polyester resin. These modified polyester resins and unmodified polyester resins will be explained later.

Microencapsulated Fatty Acid Metal Salt

The toner of the present invention includes a fatty acid metal salt (i.e., metal soaps or metal driers). The fatty acid metal salt is added to the toner to accelerate the oxidation reaction of double bonds of the unsaturated polyester resin included in the toner when the toner is heated in a fixing process. The fatty acid metal salt is preferably microencapsulated to avoid to accelerate the oxidation reaction of double bonds of the unsaturated polyester resin (i.e., to avoid occurrence of a problem in that the toner is agglomerated due to the oxidation reaction) before use. Specific examples of the fatty acid metal salts include metal salts (such as salts of cobalt, manganese, lead, zinc, copper, iron, calcium, zirconium or aluminum) and rare earth metal salts (such as salts of cerium) of fatty acids (such as octyl acid, naphthenic acid, resin acids, tall oil based fatty acids, soybean oil based fatty acids and higher fatty acids having a hydroxyl group). These fatty acid metal salts are lipophilic materials. These fatty acid metal salts can be used alone or in combination. The added amount of such fatty acid metal salts is preferably from 0.1 to 10% by weight based on the weight of the toner. When the added amount is too small, the oxidation reaction promoting effect is hardly produced. In contrast, when the added amount is too large, the electric properties of the toner deteriorate.

As for the core material of the microcapsule, resins can be used in combination with the fatty acid metal salts mentioned above. Both of natural resins and synthetic resins can be used for this purpose. Specific examples of the natural resins include dextrin, glue, casein, soybean protein, albumin, rosin, shellac, asphalt, gilsonite, tar, nitrocellulose, etc. Specific examples of the synthetic resins include polyvinyl acetate, ethylene-vinyl acetate copolymers, vinyl acetate-acrylate copolymers, polyacrylates, polymethacrylates, styrene-acrylate copolymers, vinylidene chloride-acrylate copolymers, polyvinyl chloride, vinyl chloride-vinyl acetate copolymers, synthetic rubbers, urea resins, phenolic resins, epoxy resins, polyurethane resins, cyano acrylate resins, silicone RTVs, one component epoxy resins, aqueous vinyl urethane, one component polyurethane resins using polyisocyanate (such as triphenylmethane triisocyanate), etc.

Specific examples of the synthetic rubbers for use as a core material include chloroprene rubbers; nitrile rubbers such as nitrile rubbers, phenolic resin blended nitrile rubbers, chlorinated rubber blended nitrile rubbers, nitrile rubbers blended with vinyl chloride - vinyl acetate copolymers, nitrile rubbers blended with low-cost resins, and styrene-butadiene copolymers; and thermoplastic elastomers such as elastomers of styrene-butadiene block copolymers, elastomers of styrene-isoprene block copolymers, and elastomers of styrene-ethylene-butylene block copolymers.

Solutions or emulsions of one or more of these compounds can be added to the microcapsule.

Compounds and prepolymers which can be polymerized by being reacted can also be used as a core material of the microcapsule. Suitable materials for use as the compounds and prepolymers include two component epoxy resin compounds and polyurethane compounds. Specific examples of the two component epoxy resin compounds include combinations of an epoxy oligomer (such as glycidyl ether compounds of bisphenol A, epoxy novolac, alicyclic epoxy, brominated epoxy and flexible epoxy) with a crosslinking agent (such as amines (e.g., aromatic amines and aliphatic amines), anhydrides, phenolic novolac, polyamides, polyamines, polysulfides, and Lewis acids). Two component polyurethane compounds are classified into polyisocyanate type polyurethane compounds and prepolymer type polyurethane compounds. Specific examples of the polyisocyanate type polyurethane compounds include polyisocyanate-polyol, polyisocyanate-polyester, isocyanate-polyether polyol, etc. In the prepolymer type polyurethane compounds, a prepolymer having an isocyanate group at the end portion thereof is reacted with a polyol having a hydroxyl group at the end portion thereof. Therefore, any compounds having such groups at the end portions thereof can be used. When these combinations are used, a capsule including a mixture of the two components is added to the toner or two different capsules including each of the two components are added to the toner. In addition, combinations of urea or melamine with a catalyst (such as formaldehyde resins and p-toluene sulfonic acid); and combinations of an unsaturated polyester resin dissolved in styrene with a reaction initiator such as peroxides, can also be used.

Specific examples of the method for preparing the microcapsule for use in the toner of the present invention include any known methods such as interfacial polymerization methods, in situ methods, coacervation methods, in-liquid drying methods, spray-granulizing methods, phase separation methods using water and an organic solvent, melted dispersion cooling methods, submerged crosslinked-film formation methods (i.e., orifice methods), etc. Among these methods, coacervation methods utilizing phase separation of hydrophilic colloids and in situ methods are preferably used.

Specific examples of the materials for use as the wall of the microcapsule include formaldehyde resins such as melamine resins, melamine-formaldehyde resins, urea-formaldehyde resins, sulfonamide-formaldehyde resins, and aniline-formaldehyde resins; thermosetting resins such as epoxy resins, phenolic resins, xylene resins, urea resins, polyester resins, alkyd resins, and silicone resins; other resins such as gelatin, gum arabic, sodium alginate, alkali metal salts of carboxymethyl cellulose, carrageenan, maleic anhydride copolymers, acrylic anhydride copolymers, polyvinyl alcohol, sulfated cellulose, and water-soluble nylons; etc. These resins can be used alone or in combination. One or more of monomers (such as vinylidene chloride, vinyl chloride, styrene, ethylene, acrylate, methacrylate, acrylonitrile and vinyl acetate) which can form a thermoplastic polymer or copolymer can also be used for the wall material of the microcapsule.

Organic Solvent

When toner constituents are dispersed in an aqueous medium to prepare toner particles, it is preferable to dissolve of disperse the toner constituents in an organic solvent. Suitable organic solvents for use in dissolving or dispersing toner constituents include known organic solvents. However, organic solvents having a boiling point lower than 150° C. are preferably used because of being easily removed from emulsions. Specific examples of such organic solvents include toluene, xylene, benzene, carbon tetrachloride, methylene chloride, 1,2-dichloroethane, 1,1,2-trichloroethylene, chloroform, monochlorobenzene, methyl acetate, methyl ethyl ketone, acetone, tetrahydrofuran, etc. These organic solvents can be used alone or in combination. The content of the organic solvent in an emulsion is generally from 40 to 300 parts by weight, preferably from 60 to 140 parts by weight, and more preferably from 80 to 120 parts by weight, per 100 parts by weight of the toner constituents included in the emulsion.

Polymer having Group Reactive with Active Hydrogen Atom

Any known polymers having a group reactive with an active hydrogen atom can be used for the binder resin of the toner of the present invention. Suitable resins for use as the polymer having a group reactive with an active hydrogen atom include resins having a group such as an isocyanate group, an epoxy group, a carboxyl group and an acid chloride group. Among these resins, resins having an isocyanate group are preferable. In addition, modified polyester resins having an isocyanate group are more preferable. Further, modified polyester resins (RMPE) which can form a urea bonding are even more preferably used.

Modified Polyester Resin

Any known modified polyester resins can be used as a binder resin of the toner of the present invention as long as the resins have a group which can be reacted with an active hydrogen atom. Specific examples of such a group include isocyanate groups, epoxy groups, carboxyl groups and acid chloride groups, but are not limited thereto. Among these groups, isocyanate groups are preferable.

Suitable resins for use as the modified polyester resin include polyester resins (RMPE) which are modified with a group capable of forming an urea bonding. For example, polyester prepolymers (i) having an isocyanate group can be preferably used as the modified polyester resin. Polyester prepolymers (i) having an isocyanate group can be prepared by reacting a polycondensation product of a polyol (PO) and a polycarboxylic acid (PC), i.e., a polyester resin having a group including an active hydrogen atom, with a polyisocyanate (PIC). Specific examples of the group including an active hydrogen atom include hydroxyl groups (alcoholic hydroxyl group and phenolic hydroxyl group), amino groups, carboxyl groups, mercapto groups, etc. Among these groups, the alcoholic hydroxyl group is preferable.

Modified polyester resins (RMPE) such as urea-modified polyester resins can be preferably used for dry toners, and particularly, toners for use in image forming apparatus including an oil-less fixing device. This is because the molecular weight of the polyester resins can be freely controlled, and a good combination of low temperature fixability and releasability can be imparted to the resultant toner (i.e., the toner can be used for fixing devices in which no oil is applied to the fixing member). In particular, modified polyester resins whose end portion is urea-modified are preferably used because of having as good fluidity and transparency as those of the original unmodified polyester resins in the fixable temperature range while having weak adhesiveness to the heating members of fixers.

Suitable polyols (PO) include diols (DIO), polyols (TO) having three or more hydroxyl groups, and mixtures of DIO and TO. Preferably, diols (DIO) alone or mixtures of a diol (DIO) with a small amount of polyol (TO) are used.

Specific examples of the diols (DIO) include alkylene glycols, alkylene ether glycols, alicyclic diols, bisphenols, alkylene oxide adducts of alicyclic diols, alkylene oxide adducts of bisphenols, etc.

Specific examples of the alkylene glycols include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the bisphenols include bisphenol A, bisphenol F and bisphenol S. Specific examples of the alkylene oxide adducts of alicyclic diols include adducts of the alicyclic diols mentioned above with an alkylene oxide (e.g., ethylene oxide, propylene oxide and butylene oxide). Specific examples of the alkylene oxide adducts of bisphenols include adducts of the bisphenols mentioned above with an alkylene oxide (e.g., ethylene oxide, propylene oxide and butylene oxide).

Among these compounds, alkylene glycols having from 2 to 12 carbon atoms and adducts of bisphenols with an alkylene oxide are preferable. More preferably, adducts of bisphenols with an alkylene oxide, and mixtures of an adduct of bisphenols with an alkylene oxide and an alkylene glycol having from 2 to 12 carbon atoms are used.

Specific examples of the polyols (TO) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide such as ethylene oxide, propylene oxide and butylene oxide; etc.

Suitable polycarboxylic acids (PC) include dicarboxylic acids (DIC) and polycarboxylic acids (TC) having three or more carboxyl groups. Preferably, dicarboxylic acids (DIC) alone and mixtures of a dicarboxylic acid (DIC) with a small amount of polycarboxylic acid (TC) are used.

Specific examples of the dicarboxylic acids (DIC) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include aromatic polycarboxylic acids having from 9 to 20 carbon atoms (e.g., trimellitic acid and pyromellitic acid).

When the polycarboxylic acid (PC) is reacted with a polyol (1), anhydrides or lower alkyl esters (e.g., methyl esters, ethyl esters or isopropyl esters) of the polycarboxylic acids mentioned above can also be used as the polycarboxylic acid (PC).

Suitable mixing ratio (i.e., the equivalence ratio [OH]/[COOH]) of the [OH] group of a polyol (PO) to the [COOH] group of a polycarboxylic acid (PC) is from 2/1 to 1/1, preferably from 1.5/1 to 1/1 and more preferably from 1.3/1 to 1.02/1.

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] group of a polyisocyanate (PIC) to the [OH] group of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases, thereby deteriorating the hot-offset resistance of the toner.

The content of the polyisocyanate unit in the polyester prepolymer (i) having an isocyanate group is from 0.5 to 40% by weight, preferably from 1 to 30% by weight and more preferably from 2 to 20% by weight. When the content is too low, the hot offset resistance of the toner deteriorates and in addition a good combination of preservability and low temperature fixability cannot be imparted to the resultant toner. In contrast, when the content is too high, the low temperature fixability of the toner deteriorates.

The average number of the isocyanate group included in a molecule of the polyester prepolymer (i) is generally not less than 1, preferably from 1.5 to 3, and more preferably from 1.8 to 2.5. When the average number of the isocyanate group is too small, the molecular weight of the resultant urea-modified polyester (which is crosslinked and/or extended) decreases, thereby deteriorating the hot offset resistance of the resultant toner.

The urea-modified polyester resin for use as a binder resin of the toner of the present invention can be prepared by reacting a polyester prepolymer (i) having an isocyanate group with an amine (A).

Specific examples of the amines (A) included amines (A1), polyamines (A2) having three or more amino groups, amino alcohols (A3), amino mercaptans (A4), amino acids (A5) and blocked amines (A6) in which the amines (A1-A5) mentioned above are blocked. These amines can be used alone or in combination.

Specific examples of the diamines (A1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (A2) having three or more amino groups include diethylene triamine, triethylene tetramine, etc. Specific examples of the amino alcohols (A3) include ethanol amine, hydroxyethyl aniline, etc. Specific examples of the amino mercaptan (A4) include aminoethyl mercaptan, aminopropyl mercaptan, etc. Specific examples of the amino acids (A5) include aminopropionic acid, aminocaproic acid, etc. Specific examples of the blocked amines (A6) include ketimine compounds which are prepared by reacting one of the amines (A1-A5) mentioned above with a ketone such as acetone, methyl ethyl ketone and methyl isobutyl ketone; oxazoline compounds, etc. Among these amines, diamines (A1) and mixtures of a diamine (A1) with a small amount of a polyamine (A2) are preferably used.

The molecular weight of the urea-modified polyesters can be controlled using a molecular chain extension inhibitor, if desired. Specific examples of the molecular chain extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] group of the prepolymer (i) having an isocyanate group to the [NHx] group of the amine (A) is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

The urea-modified polyester resins (UMPE) for use in the toner of the present invention can include a urethane bonding as well as a urea bonding. The molar ratio of the urea bonding to the urethane bonding is from 100/0 to 10/90, preferably from 80/20 to 20/80, and more preferably from 60/40 to 30/70. When the molar ratio of the urea bonding is too low, the hot offset resistance of the resultant toner deteriorates.

Suitable materials for use as the crosslinking agents and molecular chain extension agents include compounds which have an active hydrogen and which can be reacted with a reactive group such as isocyanate groups. Among the materials, amines (A) are preferably used.

The urea-modified polyesters can be prepared, for example, by a method such as one-shot methods or prepolymer methods. The weight average molecular weight of the urea-modified polyesters is generally not less than 10,000, preferably from 20,000 to 1,000,000 and more preferably from 30,000 to 1,000,000. When the weight average molecular weight is too low, the hot offset resistance of the resultant toner deteriorates.

The number average molecular weight of the urea-modified polyester resin is not particularly limited if an unmodified polyester resin (ii) is used in combination therewith. Specifically, the weight average molecular weight of the urea-modified polyester resin is mainly controlled rather than the number average molecular weight. When the urea-modified polyester resin is used alone, the number average molecular weight of the resin is preferably not greater than 20,000, preferably from 1,000 to 10,000, and more preferably from 2,000 to 8,000. When the number average molecular weight is too high, the low temperature fixability of the resultant toner deteriorates. In addition, when the toner is used as a color toner, the resultant toner has low glossiness.

Crosslinking Agent and Molecular Chain Extension Agent

As mentioned above, when the polyester prepolymer having an isocyanate group is crosslinked and/or extended, amines are preferably used as a crosslinking agent and/or a molecular chain extension agent.

Specific examples of the amines include amines (A1) to (A6) mentioned above. Among the amines, diamines (A1) and mixtures of a diamine (A1) with a small amount of a polyamine (A2) are preferably used.

The preferable mixing ratio of a polyester prepolymer to an amine is also mentioned above.

In addition, as mentioned above, a crosslinking inhibitor and/or a molecular chain extension inhibitor can be used. Specific examples thereof are mentioned above.

Unmodified Polyester Resin

It is preferable to use a combination of a modified polyester resin (i) with an unmodified polyester resin (ii) having an acid value of from 0.5 to 30 mgKOH/g and a crystalline polyester resin (iii), as a binder resin of the toner of the present invention. By using such a combination, the low temperature fixability of the toner can be improved and in addition the toner can produce color images having a high glossiness.

Suitable materials for use as the unmodified polyester resins (ii) include polycondensation products of a polyol (1) with a polycarboxylic acid (2). Specific examples of the polyol (1) and polycarboxylic acid (2) are the compounds mentioned above for use in the modified polyester resins. In addition, specific examples of the suitable polyol and polycarboxylic acid are also mentioned above.

The unmodified polyester resin (ii) can include a bonding (such as urethane bonding) other than the urea bonding.

When a combination of a modified polyester resin (i) with an unmodified polyester resin (ii) and a crystalline polyester resin (iii) is used as the binder resin, it is preferable that the polyester resins (i), (ii) and (iii) are at least partially mixed with the others to improve the low temperature fixability and hot offset resistance of the resultant toner. Namely, it is preferable that the polyester components of the polyester resins (i) and (iii) have a molecular structure similar to that of the unmodified polyester resin (ii).

The weight ratio among the modified polyester resin (i) to the total of the unmodified polyester resin (ii) and the crystalline polyester resin (iii) is generally from 5/95 to 75/25, preferably from 10/90 to 25/75, more preferably from 12/88 to 25/75, and even more preferably from 12/88 to 22/78. When the content of the modified polyester resin (i) is too low, the hot offset resistance of the toner deteriorates, and in addition good combination of high temperature preservability and low temperature fixability cannot be imparted to the resultant toner.

The unmodified polyester resin (ii) for use in the toner of the present invention typically has a main peak molecular weight of from 1,000 to 30,000, preferably from 1,500 to 10,000 and more preferably from 2,000 to 8,000. When the content of the components having a molecular weight less than 1,000 in the unmodified polyester resin increases, the resultant toner has a poor preservability, and contaminates the carrier used for forming a two component developer. Therefore, the content of such components is preferably not greater than 5.0% by weight. In contrast, when the content of the components having a molecular weight greater than. 30,000 increases, the low temperature fixability of the toner tends to deteriorate. In this case, by balancing the content of the low molecular weight components with that of the high molecular weight components, the degree of deterioration of low temperature fixability can be decreased. The content of the components having a molecular weight greater than 30,000 is typically not less than 1% by weight, and preferably from 3 to 6% by weight although the content is determined depending on the materials used for the toner. When the content is too low, good hot offset resistance cannot be imparted to the resultant toner. In contrast, when the content is too high, there is a case where the resultant toner produces images having low glossiness and low transparency.

The unmodified polyester resin preferably has a number average molecular weight (Mn) of form 2,000 to 15,000 and a Mw/Mn ratio of the weight average molecular weight (Mw) to the number average molecular weight (Mn) of not greater than 5. When the Mw/Mn ratio is too large, sharp melting property cannot be imparted to the resultant toner and in addition the resultant toner images have low glossiness. When an unmodified polyester resin including tetrahydrofuran(THF)-insoluble components in an amount of from 1 to 15% by weight, the hot offset resistance of the toner can be enhanced. When the content of THF-insoluble components is too high, the glossiness and transparency of the resultant color toner images deteriorate although the hot offset resistance can be enhanced.

In the present invention, the molecular weight of an unmodified polyester resin (ii) included in the toner is measured by the following method:

(1) a toner of about 1 gram is precisely weighed;

(2) the toner is mixed with 10 to 20 g of tetrahydrofuran to prepare a tetrahydrofuran solution of the binder resin having a concentration of about 5 to 10%;

(3) tetrahydrofuran is flown through a column, which is heated in a heat chamber at 40° C., at a flow rate of 1 ml/min and 20 μl of the sample solution is injected thereto to determine the molecular weight distribution of the binder resin using a working curve concerning the relationship between a molecular weight and a retention time which is previously prepared using polystyrenes having a single molecular distribution of from $2.7\times10^2$ to $6.2\times10^6$.

As the detector, a RI (refractive index) detector is used. As the column, TSKgel, G1000H, G2000H, G2500H, G3000H, G4000H, G5000H, G6000H, G7000H and GMH, which are manufactured by TOSO CORPORATION, are used in combination.

The unmodified polyester resin (ii) preferably has a hydroxyl value not less than 5 mgKOH/g, and more preferably from 10 to 120 mgKOH/g, and even more preferably from 20 to 80 mgKOH/g. When the hydroxyl value is too small, it is hard to impart good combination of preservability and low temperature fixability to the resultant toner. When the hydroxyl value is too large, the properties (such as charge properties) of the resultant toner seriously change depending on environmental conditions such as temperature and humidity, resulting in deterioration of image qualities.

The unmodified polyester resin (ii) preferably has an acid value of from 0.5 to 30 mgKOH/g, and more preferably from 5 to 30 mgKOH/g. When a resin having an acid value in this range is used as a binder resin, good negative charge property can be imparted to the toner. When the acid value is too large, the properties (such as charge properties) of the resultant toner seriously change depending on environmental conditions such as temperature and humidity, resulting in deterioration of image qualities.

In order to control the content of THF-insoluble components included in the resultant toner, it is preferable to adjust the degree of extension and/or crosslinking of the modified polyester resin by controlling the acid value of the unmodified polyester resin (specifically, the more the acid value of the unmodified polyester, the lower the degree of extension and/or crosslinking of the modified polyester resin).

The content of THF-insoluble components included in a resin or a toner can be determined by the following method:

(1) a resin (or a toner) of about 1 gram is precisely weighed;
(2) the resin is mixed with about 50 g of tetrahydrofuran;
(3) the mixture is allowed to settle for 24 hours at 20° C.;
(4) the mixture is subjected to a centrifugal treatment, followed by filtration using a filter paper 5C specified in JIS P3801; and
(5) the filtrate is dried by a vacuum drying method to determine the weight of the THF-soluble components in the toner.

The THF-insoluble component content of the resin sample can be determined by the following equation:

$$\text{THF-insoluble content (\%)}=\{(A-B)/A\}\times 100$$

wherein A represents the weight of the resin sample, and B represents the weight of the THF-soluble components.

In general, other toner constituents included in the toner such as colorants and release agents also include THF-insoluble components. Therefore, it is necessary to previously determine the weight (W1) of the THF-insoluble materials included in the toner constituents other than the resin components and the weight of the THF-soluble components (W2) therein by a known method such as thermogravimetry. In this case, the THF-insoluble component content in the resin is determined as follows.

$$\text{THF-insoluble content (\%)}=\{(A-B-W2)/(A-W1-W2)\}\times 100$$

The glass transition temperature of the toner including a modified polyester resin (i) and an unmodified polyester resin (ii) as the binder resin is preferably from 40 to 70° C., and more preferably from 45 to 55° C. In this regard, since the modified polyester resin (i) has a very high molecular weight, the resin (i) does not have a clear Tg. Therefore, the Tg of the toner is substantially the same as that of the polyester resin (ii). Accordingly, the Tg of the toner is controlled by controlling the Tg of the unmodified polyester resin (ii). When the glass transition temperature is too low, the high temperature preservability of the toner deteriorates. In contrast, when the glass transition temperature is too high, the low temperature fixability of the toner deteriorates. Since a combination of a urea-modified polyester resin and an unmodified polyester resin is included in the toner, the toner of the present invention tends to have better preservability than that of conventional toners including a known polyester resin even when the glass transition temperature of the toner of the present invention is lower than that of the conventional toners.

Crystalline Polyester

The toner of the present invention preferably includes a crystalline polyester resin (iii) as an unsaturated polyester resin to impart good low temperature fixability to the toner. Specifically, when an image of the toner is heated by a fixing member to a temperature not lower than the melting point of the crystalline polyester resin (iii), the crystalline polyester resin (iii) not only causes crystal transition but also changes rapidly from a solid state to a liquid state having a low melt viscosity. Therefore the toner image is penetrated into a receiving paper. In addition, when the thus melted toner image is released from the fixing member, the toner image is rapidly solidified. The toner-of the present invention includes a crystalline polyester resin (iii) and the glass transition temperature (Tg) and melting point T(F1/2) of the crystalline polyester resin (iii) are controlled so as to be in proper ranges such that the high temperature preservability and hot offset resistance of the resultant toner do not deteriorate. Therefore, the toner has a good combination of low temperature fixability, high temperature preservability and hot offset resistance.

Specifically, the glass transition temperature (Tg) of the crystalline polyester resin (iii) is generally from 65 to 140° C., and preferably from 80 to 135° C. In addition, the melting point T(F1/2) of the crystalline polyester resin (iii) is generally from 65 to 140° C., and preferably from 80 to 135° C. When the Tg and T(F1/2) are too high, the toner has a poor low temperature fixability.

The crystalline polyester resin (iii) used for the toner of the present invention preferably has an X-ray diffraction spectrum such that at least one diffraction peak is observed in a Bragg (2 θ) angle range of from 20° to 25°, and preferably at least one diffraction peak is observed in each of the Bragg (2 θ) angle ranges of from 19° to 20°, from 21° to 22°, from 23° to 25° and from 29° to 31°.

In order that the crystalline polyester resin (iii) has a preferable crystalline structure while having proper glass transition temperature and melting point, resins prepared by reacting an alcohol component including a diol having from 2 to 6 carbon atoms (particularly, 1,4-butanediol, 1,6-hexanediol and derivatives thereof) in an amount not smaller than 80% by mole and preferably from 85 to 100% by mole with an acid component selected from the group consisting of fumaric acid, carboxylic acids having a double bond and derivatives thereof are preferably used as the crystalline polyester resin (iii). Specifically, the crystalline polyester resin (iii) preferably has the following formula (1):

$$[\text{—O—CO—}(CR_1{=}CR_2)_L\text{—CO—O—}(CH_2)_n\text{—}]_m \quad (1),$$

wherein each of n and m is a repeat number and is a positive integer; L is an integer of from 1 to 3; and each of $R_1$ and $R_2$ represents a hydrogen atom, or a hydrocarbon group.

In this case, in order to control the crystallinity and melting point of the crystalline polyester resin (iii), a polyhydric alcohol such as glycerin and/or a polycarboxylic acid such as trimellitic anhydride can be used when the polyester resin (iii)

is synthesized by the method mentioned above. In this case, the resultant polyester resin has a non-linear structure.

Whether or not a crystalline polyester resin has formula (1) can be determined by analyzing the resin by a method such as NMR methods, X-ray diffraction methods, gas chromatograph mass spectrometry (GC/MS), liquid chromatograph mass spectrometry (LC/MS), and infrared spectroscopy (IR). Among these measurement methods, infrared spectroscopy (IR) is preferably used because of being simple. In this case, it is preferable that the crystalline polyester resin (iii) has an absorption due to the δ CH (i.e., out-of-plane angle-changing vibration) of an olefin is observed at 965±10 $cm^{-1}$ or 990±10 $cm^{-1}$.

The polyester resin included in the toner of the present invention preferably has a relatively low molecular weight while having a sharp molecular weight distribution to impart good low temperature fixability to the toner. Specifically, it is preferable that the o-dichlorobenzene-soluble components of the crystalline polyester resin (iii) have a weight average molecular weight (Mw) of from 1,000 to 30,000, a number average molecular weight (Mn) of from 500 to 6,000 and a ratio (Mw/Mn) of from 2 to 8.

In addition, the crystalline polyester resin (iii) included in the toner of the present invention preferably has an acid value of from 5 to 45 mgKOH/g, and more preferably from 10 to 40 mgKOH/g, and a hydroxyl value of from 5 to 50 mgKOH/g, and more preferably from 10 to 45 mgKOH/g.

Further, in order to impart a good combination of low temperature fixability, hot offset resistance and high temperature preservability to the toner, the weight ratio of the modified polyester resin (i) to the total of the unmodified polyester resin (ii) and the crystalline polyester resin (iii) is from 5/95 to 25/75, preferably from 10/90 to 25/75 and more preferably from 12/88 to 25/75, and the weight ratio of the unmodified polyester resin (ii) to the crystalline polyester resin (iii) is from 99/1 to 50/50, preferably from 95/5 to 60/40 and more preferably from 90/10 to 65/35.

The methods for measuring the properties mentioned above are as follows.

(1) Melting Point T(F1/2)

The melting point T(F1/2) of a resin is an index of whether or not the resin can be easily melted. Specifically, when a resin has a high melting point, the resin has poor melting property, i.e., the resin can be melted by being heated to a high temperature. In contrast, when a resin has a low melting point, the resin has good melting property, i.e., the resin can be melted even when heated to a low temperature.

The melting point T(F1/2) of a resin is determined using an instrument FLOW TESTER CFT-500 manufactured by Shimadzu Corporation. Measurements are performed under the following conditions:

1) amount of sample: 1 $cm^3$
2) diameter of die: 1 mm
3) pressure: 10 $kgf/cm^2$
4) temperature rising speed: 3° C./min Specifically, a sample (resin) is heated and melted under the conditions mentioned above while the melt flow property is graphed to determine the 1/2 temperature T(F1/2) which is the midpoint of the flow starting point and the flow ending point. The T(F1/2) temperature, which is illustrated in the figure, is defined as the melting point.

(2) Glass Transition Temperature (Tg)

The glass transition temperature (Tg) means a temperature at which the resin changes its state from a glass state to a rubber state. In a case of crystalline polyester resins partially having a crystalline structure, the resins are melted and achieve a liquid state at the glass transition temperature thereof.

The glass transition temperature of a toner or a resin is measured by a TG-DSC system TAS-100 manufactured by RIGAKU CORPORATION. The procedure for measurements of glass transition temperature is as follows:

1) a sample of about 10 mg is contained in an aluminum container, and the container is set on a holder unit;
2) the holder unit is set in an electrical furnace, and the sample is heated from room temperature to 150° C. at a temperature rising speed of 10° C./min;
3) after the sample is allowed to settle at 150° C. for 10 minutes, the sample is cooled to room temperature; and
4) after the sample is allowed to settle at room temperature for 10 minutes, the sample is heated again under a nitrogen atmosphere from room temperature to 150° C. at a temperature rising speed of 10° C./min to perform a DSC measurement.

The glass transition temperature of the sample was determined using an analysis system of the TAS-100 system. Namely, the glass transition temperature is defined as the contact point between the tangent line of the endothermic curve at the temperatures near the glass transition temperature and the base line of the DSC curve.

(3) Acid Value and Hydroxyl Value

The acid value of a resin is an index of the number of carboxyl groups included in the resin, and the hydroxyl value of a resin is an index of the number of hydroxyl groups included in the resin. The acid value and hydroxyl value of a resin are measured by the method described in JIS K0070. When the resin is not dissolved by the solvent specified in JIS K0070, dioxane, tetrahydrofuran or o-dichlorobenzene is used as the solvent. The unit of the acid value and hydroxyl value is mgKOH/g.

(4) Molecular Weight Distribution

The molecular weight of a resin is determined by a GPC (Gel Permeation Chromatography) method using tetrahydrofuran (THF) as a solvent. The measuring method is as follows.

At first, the column is stabilized in a heat chamber at 145° C. A solvent including o-dichlorobenzene including BHT in an amount of 0.3%, which serves as an eluant, is flown through the column at a speed of 1 ml/minute. On the other hand, a resin to be measured is dissolved in o-dichlorobenzene to prepare a solution of the resin having a resin content of 0.3% by weight. Then 50 to 200 μl of the solution of the resin, which is heated to 140° C., is injected into the column to obtain a GPC spectrum. The measuring conditions are as follows.

Instrument: 150CV from Waters Co.

Column: SHODEX AT-G and AT-806MS (two pieces)

The molecular weight of the resin is determined while comparing the molecular distribution curve thereof with the working curve which is previously prepared using several polystyrene standard samples each having a single molecular weight peak. Specific examples of the polystyrene standard samples include standard polystyrenes which are manufactured by Pressure Chemical Co. or Tosoh Corporation and each of which has a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

It is preferable to prepare a working curve using at least ten standard polystyrenes. A refractive index (RI) detector is used as the detector.

(5) X-Ray Diffraction Spectrum

In the present application, the X-ray diffraction analysis is performed under the following measuring conditions.

Measuring instrument: RINT1100 from Rigaku Corp.
Target: Cu
Voltage: 50 kV
Current: 30 mA
Goniometer: wide angle goniometer (6) Analysis of Molecular Structure of Resin Whether a resin includes a group having formula (1) is determined by subjecting the resin to a solid $^{13}$C-NMR analysis under the following conditions.

Instrument used: FT-NMR SYSTEM JNM-α400 from JEOL Ltd.)
Measurement nucleus: $^{13}$C
Reference material: adamantane
Number of accumulation: 8192 times
Pulse sequence: CPMAS
IRMOD: IRLEV
Measurement frequency: 100.4 MHz
OBSET: 134500 Hz
POINT: 4096
PD: 7.0 sec
SPIN: 6088 Hz
Software used for analysis: CHEM DRAW PRO Ver. 4.5

In addition to the solid $^{13}$C-NMR analysis, the resin is also subjected to a FT-IR analysis and a pyrolysis gas chromatographic analysis to support the results of the NMR analysis. The details of the analyses are as follows.

1) FT-IR (Fourier Transform Infrared Spectrophotometry)

The resin is subjected to transmission FT-IR, and the spectrum is compared with the standard spectrum. The measuring conditions are as follows.

Instrument used: NICOLET MAGNA 850
Measurement range: 4000 to 400 $cm^{-1}$
Reference material: KBr 2) Pyrolysis Gas Chromatographic Analysis Thee heat decomposition materials of the resin are analyzed using a pyrolysis gas chromatographic analyzer. The measurement conditions are as follows.

Instrument used: GC-17A and CR-4A from Shimadzu Corp.
Heating chamber: JHB-3S from Japan Analytical Industry Co., Ltd.
Pyrolysis condition: 590° C. (temperature)×4 sec (time)
Column: DB-5 (J and W Co.)
Length: 30 m
Inside diameter: 0.25 mm
Film: 0.25 mm
Column temperature: The temperature is raised from 50° C. (retained at the temperature for 1 min) to 300° C. at a speed of 10° C./min.
Injection temperature: 320° C.
Carrier gas pressure: The pressure is raised from 90 kPa (retained at the pressure for 2 min) to 150 kPa at a speed of 2 kPa/min.
Detector: FID Colorant The toner for use in the present invention includes a colorant. Suitable materials for use as the colorant include known dyes and pigments.

Specific examples of the dyes and pigments include carbon black, Nigrosine dyes, black iron oxide, NAPHTHOL YELLOW S (C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN (C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R (C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R (C.I. 12310), PERMANENT RED F4R (C.I. 12335), PERMANENT RED FRL (C.I. 12440), PERMANENT RED FRLL (C.I. 12460), PERMANENT RED F4RH (C.I. 12420), Fast Scarlet VD, VULCAN FAST RUBINE B (C.I. 12320), BRILLIANT SCARLET G, LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazored, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS (C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

In addition, it is preferable to subject the colorants to a surface treatment. Specific examples of the surface treatment agents include natural rosins such as gum rosin, wood rosin, and tall rosin; abietic acid derivatives such as abietic acid, levopimaric acid, dextropimaric acid and salts (such as Ca, Na, K and Mg) thereof; rosin-modified maleic acid resins, rosin-modified phenolic acid resins, etc. In particular, acidic surface treatment agents are preferably used in order to enhance the affinity of the colorant for the dispersant used.

The added amount of the surface treatment agents is preferably from 0.1 to 100% by weight, and more preferably from 0.1 to 10% by weight, based on the total weight of the colorant used.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl a-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent and water, if desired are removed from the mixture can be preferably used because the resultant wet cake can be used as it is without being dried. When performing the mixing and kneading process, dispersing devices capable of applying a high shearing force such as three roll mills can be preferably used.

Dispersant

When a colorant is dispersed in a resin, a dispersant is preferably used. Suitable materials for use as the dispersant include basic copolymer dispersants, modified polyurethane dispersants, polyester dispersants, (meth)acrylic dispersants, derivatives of colorants, etc.

When a colorant is dispersed in an organic solvent, the weight ratio of the colorant to the organic solvent is preferably from 5/95 to 50/50. When the weight ratio is too small, the amount of the dispersion increases, resulting in deterioration of productivity of the toner. In contrast, when the weight ratio is too large, the colorant is not well dispersed.

When a colorant is included in the toner, not only a colorant dispersion which is prepared by dispersing only a colorant in an organic solvent but also a dispersion in which a colorant and a resin are dispersed in an organic solvent can be used. In the former case, a small amount of resin can be added in the dispersing process to control the viscosity and to apply a proper shearing force to the colorant.

The average particle diameter of the colorant in the dispersion after the dispersion process is preferably not greater than 1 μm. When the average particle diameter of a colorant in the dispersion is too large, the image qualities of the resultant toner images deteriorate (particularly, the image qualities of images formed on a transparent film for use in overhead projection (OHP) deteriorate) because the particle diameter of the colorant in the resultant toner is large and the toner images have low transparency. The average particle diameter, and particle diameter distribution of a colorant can be determined with a laser diffraction/scatter particle diameter distribution measuring instrument, LA-920 from Horiba Ltd.

In order to stably disperse a colorant by enhancing the interaction between the colorant and a modified polyurethane dispersant, the pigment is preferably subjected to a surface treatment. Suitable compounds for use as the surface treatment agent include natural rosins such as gum rosin, wood rosin, and tall rosin; abietic acid derivatives such as abietic acid, levopimaric acid, and dextropimaric acid and metal (such as Ca, Na, K and Mg) salts thereof; rosin-modified maleic acid resins, rosin-modified phenolic acids, etc. Particularly, in order to enhance the affinity of the colorant for a dispersant, an acidic surface treatment agent is preferably used. The added amount of the surface treatment agent is preferably from 0.1 to 100% by weight, and preferably from 0.1 to 10% by weight, of the weight of the colorant included in the toner.

Release Agent

The toner of the present invention can include a release agent. Known waxes can be used as the release agents. Specific examples of the waxes include polyolefin waxes such as polyethylene waxes and polypropylene waxes; hydrocarbons having a long chain such as paraffin waxes and SASOL waxes; waxes having a carbonyl group; etc.

Among these waxes, waxes having a carbonyl group are preferably used. Specific examples of the waxes having a carbonyl group include esters of polyalkanoic acids (e.g., carnauba waxes, montan waxes, trimethylolpropane tribehenate, pentaerythritol tetrabehenate, pentaerythritol dictated dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkananoic acid esters are preferably used.

The melting point of the waxes for use in the toner is generally from 40 to 160° C., preferably from 50 to 120° C., more preferably from 60 to 90° C. When the melting point of the wax used is too low, the high temperature preservability of the resultant toner deteriorates. In contrast, when the melting point is too high, the resultant toner tends to cause a cold offset problem in that a toner image adheres to a fixing roller when the toner image is fixed at a relatively low fixing temperature.

The waxes preferably have a melt viscosity of from 5 to 1,000 mPa·s (i.e., 5 to 1,000 cps), and more preferably from 10 to 100 mPa·s (i.e., 10 to 100 cps), at a temperature 20° C. higher than the melting point thereof. Waxes having too high a melt viscosity hardly produce hot offset resistance improving effect and low temperature fixability improving effect. In contrast, waxes having too low a melt viscosity deteriorates the releasability of the resultant toner.

The content of a wax in the toner of the present invention is generally from 0 to 40% by weight, and preferably from 3 to 30% by weight.

Charge Controlling Agent

The toner of the present invention can include a charge controlling agent, if desired. Any known charge controlling agents can be used for the toner.

Suitable examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

The content of the charge controlling agent in the toner for use in the present invention is determined depending on the variables such as choice of binder resin, presence of additives, and dispersion method. In general, the content the charge controlling agent is preferably from 0.1 to 10 parts by weight, and more preferably from 0.2 to 5 parts by weight, per 100 parts by weight of the binder resin included in the toner. When the content is too low, a good charge property cannot be imparted to the toner. When the content is too high, the charge quantity of the toner excessively increases, and thereby the electrostatic attraction between the developing roller and the toner increases, resulting in deterioration of fluidity and decrease of image density.

The charge controlling agent is kneaded together with a master batch, and the mixture is used for preparing toner particles. Alternatively, the charge controlling agent is dissolved or dispersed in an organic solvent together with other toner constituents. It is possible to adhere and fix a charge controlling agent to a surface of toner particles which are previously prepared.

Particulate Resin

A particulate resin is preferably added when the toner particles are prepared, to control the circularity and particle diameter distribution of the toner particles. The particulate resin preferably has a glass transition temperature of from 30 to 70° C. and a weight average molecular weight of from 8,000 to 400,000. When the glass transition temperature and/or the weight average molecular weight are too low, the preservability of the toner deteriorates, resulting in occurrence of a problem in that the toner causes blocking phenomenon during storage or in developing devices. In contrast, when the glass transition temperature and/or the weight average molecular weight are too high, the minimum fixable temperature of the toner increases because the particulate resin adversely affects the adhesion of the toner to receiving materials.

Therefore, it is preferable to control the amount of the particulate resin remaining on the surface of the toner particles so as to be from 0.5 to 5.0% by weight. When the amount of the particulate resin is too small, the preservability of the toner deteriorates, resulting in occurrence of the blocking problem. When the amount of the particulate resin is too large, the particulate resin prevents the release agent from exuding from the toner particles, resulting in occurrence of the offset problem.

The amount of a particulate resin remaining on the surface of a toner can be determined by the following method. Namely, the toner is subjected to a pyrolysis gas chromatography to determine the amount of the particulate resin therein by checking the area of a peak specific to a substance which is included in the particulate resin but not included in the other toner constituents. As the detector, a mass spectrometer is preferably used but is not limited thereto.

Suitable materials for use as the particulate resin include any known resins which can be dispersed in an aqueous medium. Specific examples of such resins include thermoplastic and thermosetting resins such as vinyl resins, polyurethane resins, epoxy resins, polyester resins, polyamide resins, polyimide resins, silicon-containing resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins and combinations thereof are preferably used because aqueous dispersions of the resins can be easily prepared. Specific examples of the vinyl resins include homopolymers and copolymers of vinyl monomers such as styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, etc.

The volume average particle diameter of the particulate resins is preferably from 5 to 500 nm. When the average particle diameter is too small, particles or a film of the particulate resin tends to cover the entire surface of the toner particles, resulting in increase of the minimum fixable temperature of the resultant toner. In addition, it becomes impossible to control the particle diameter and particle form of the toner particles. In contrast, when the average particle diameter is too large, the resultant toner particles have a rough surface because the large particulate resin is adhered to the surface of the toner particles. Such a large particulate resin tends to release from the toner surface when the toner is agitated in developing devices, resulting in occurrence of a problem in that a release agent included in the toner particles is released from the toner particles. The volume average particle diameter of the particulate resin can be determined by a laser diffraction/scatter particle diameter distribution measuring instrument, LA-920 from Horiba Ltd.

External Additive

The thus prepared toner particles may be mixed with an external additive to improve the preservability and charge properties of the toner. In organic fine particles are typically used as the external additive. Particulate inorganic materials having a primary particle diameter of from 0.5 nm to 200 nm and more preferably from 0.5 nm to 50 nm are typically used. The specific surface area of the particulate inorganic materials is preferably from 20 to 500 $m^2/g$ when measured by a BET method.

The content of the particulate inorganic material is preferably from 0.01% to 5.0% by weight, and more preferably from 0.01% to 2.0% by weight, based on the total weight of the toner.

Specific examples of such particulate inorganic materials include tricalcium phosphate, colloidal silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, hydroxyapatite, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin, can also be used as the external additive of the toner for use in the present invention.

The external additive added to the toner particles is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylating agents, silane coupling agents having a fluorinated alkyl group, organic titanate coupling agents, aluminum coupling agents, silicone oils, modified silicone oils, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods. When particulate resins are used as the cleanability improving agent, it is preferably for the particulate resins to have a relatively narrow particle diameter distribution and a volume average particle diameter of from 0.01 μm to 1 μm.

The toner of the present invention preferably has a specific surface area of from 0.5 to 6.0 $m^2/g$, which is determined by a BET method. When the BET specific surface area is too low, image qualities (such as resolution) of the resultant toner images deteriorate because coarse particles are present in the toner. In contrast, when the BET specific surface area is too high, image qualities of the resultant toner images deteriorate (for example, background development occurs) due to fine particles present in the toner.

The specific surface area of a toner can be determined using an instrument, such as NOVA series instruments from Yuasa Ionics Inc., which is defined in JIS Z8830 and R1626.

Toner Preparation Method

Then the method for preparing the toner of the present invention will be explained.

At first, the polyester prepolymer (i) which can be reacted with a compound having an active hydrogen atom and which is used for the binder resin of the toner of the present invention will be explained. The polyester prepolymer (i) is prepared, for example, by the following method:

(1) at first, a polyol (1) and a polycarboxylic acid (2) are heated to a temperature of from 150 to 280° C. in the presence of an esterification catalyst such as tetrabutoxy titanate and dibutyltin oxide to be reacted while generated water is removed under a reduced pressure if necessary, resulting in preparation of a polyester resin having a hydroxyl group; and (2) the polyester resin is reacted with a polyisocyanate (3) at a temperature of from 40 to 140° C., resulting in preparation of a polyester prepolymer (i).

Then the method for preparing toner particles will be explained. The toner particles are typically prepared by the following method, but the preparation method is not limited thereto.

Preparation of Toner in Aqueous Medium

Toner particles are preferably prepared by reacting a dispersion including a polyester prepolymer (i) having an isocyanate group, which is dissolved or dispersed in an organic solvent, with an amine (A) in an aqueous medium. In order to stably disperse the polyester prepolymer (i) (or toner constituents) in an aqueous medium, a method in which a shearing force is applied to the polyester prepolymer (i) (i.e., toner constituents) is preferably used. The toner constituents (e.g., colorants, colorant master batches, release agents, charge controlling agents, and unmodified polyester resins) other than the binder resin can be mixed when the toner composition liquid is dispersed in an aqueous medium, but it is preferable that such toner constituents are previously dissolved or dispersed in the toner composition liquid and then the resultant toner composition liquid is dispersed in an organic solvent. The toner constituents other than the binder resin, such as the colorant, release agent and charge controlling agent, are not necessarily added to an organic solvent when the toner composition liquid is prepared, and can be added to the particles including the binder resin, which are prepared in an aqueous medium. For example, a colorant can be added to the toner by a method in which particles prepared in an aqueous medium and including no colorant is dyed with a known dyeing method using the colorant.

Specific examples of the aqueous medium include water and water-soluble solvents such as alcohols (e.g., methanol, isopropanol and ethylene glycol), dimethylformamide, tetrahydrofuran, cellosolves (e.g., methylcellosolve), lower ketones (e.g., acetone and methyl ethyl ketone), etc.

The dispersing method is not particularly limited, and known mixers and dispersing machines such as low shearing force type dispersing machines, high shearing force type dispersing machines, friction type dispersing machines, high pressure jet type dispersing machines and ultrasonic dispersing machine can be used.

In order to prepare the toner for use in the present invention, it is preferable to prepare an emulsion including particles having an average particle diameter of from 2 to 20 μm. Therefore, high shearing force type dispersing machines are preferably used.

When high shearing force type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 40 to 98° C. The processing temperature is preferably as high as possible because the viscosity of the dispersion decreases and thereby the dispersing operation can be easily performed.

When the toner constituent liquid is dispersed in an aqueous medium, the weight ratio of the aqueous medium to the toner constituents is generally from 50/100 to 20,000/100, and preferably from 100/100 to 10,000/100. When the amount of the aqueous medium is too small, the toner constituents cannot be well dispersed, and thereby a toner having a desired particle diameter cannot be prepared. In contrast, to use a large amount of aqueous medium is not economical.

A dispersant can be used for dispersing the oil phase liquid in the aqueous phase liquid to prepare toner particles having a sharp particle diameter distribution and to prepare a stable emulsion.

Specific examples of the surfactants for use in emulsifying a toner composition liquid in an aqueous medium include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di(octylaminoethyle) glycin, and N-alkyl-N,N-dimethylammonium betaine.

By using a fluorine-containing surfactant as the surfactant, good effects can be produced even when the added amount of the surfactant is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10) -N-ethylsulfonyl glycin, monoperfluoroalkyl(C6-C16)ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse the toner composition liquid (i.e., the oil phase liquid) in an aqueous medium, include primary, secondary and tertiary aliphatic amines having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, inorganic dispersants which are hardly soluble in water can also be used as the dispersant. Specific examples thereof include tricalcium phosphate, calcium carbonate, colloidal titanium oxide, colloidal silica, and hydroxyapatite.

Further, it is preferable to stabilize the emulsion using a polymer protection colloid.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protection colloid.

When a dispersant is used for dispersing the toner constituent mixture in an aqueous medium, the dispersant is preferably removed by washing the resultant toner particles after the crosslinking and/or molecular chain extension reaction in order to impart good charge properties to the toner particles although it is possible that the dispersant is allowed to remain on the surface of the toner particles.

When a dispersant, which can be dissolved in an acid or an alkali, such as calcium phosphate, is used, it is preferable to dissolve the dispersant with hydrochloric acid to remove that from the toner particles, followed by washing. In addition, it is possible to remove such a dispersant by decomposing the dispersant using an enzyme.

The molecular chain extension and/or crosslinking reaction time is determined depending on the reactivity of the isocyanate group of the polyester prepolymer with the amine used, and is generally from 10 minutes to 40 hours, and preferably from 2 hours to 24 hours. The reaction temperature is generally from 0 to 150° C., and preferably from 40 to 98° C.

In addition, known catalysts such as dibutyltin laurate and dioctyltin layrate can be used for the reaction, if desired.

In order to remove an organic solvent from the thus prepared emulsion, a method in which the emulsion is gradually heated to perfectly evaporate the organic solvent in the emulsion can be used. Alternatively, a method in which the emulsion is sprayed in a dry environment to dry the organic solvent in the drops of the toner constituent liquid and water in the emulsion, thereby forming toner particles, can also be used. Specific examples of the dry environment include gases of air, nitrogen, carbon dioxide, combustion gas, etc., which are preferably heated to a temperature not lower than the boiling point of the solvent having the highest boiling point among the solvents included in the emulsion. Toner particles having desired properties can be rapidly prepared by performing this treatment using a spray dryer, a belt dryer, a rotary kiln, etc.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to perform the classification operation in the liquid having the particles in view of efficiency. The toner particles having an undesired particle diameter can be reused as the raw materials for the kneading process. Such toner particles for reuse may be in a dry condition or a wet condition.

The dispersant used is preferably removed from the particle dispersion. The dispersant is preferably removed from the dispersion when the classification treatment is performed.

The thus prepared dry toner particles can be mixed with one or more other particulate materials such as external additives mentioned above, release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Carrier for Use in Two Component Developer

The thus prepared toner can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 μm. The surface of the carriers may be coated with a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethyl methacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner prepared above can also be used as a one-component magnetic developer or a one-component non-magnetic developer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Particulate Resin Emulsion

Manufacturing Example 1

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were mixed. The mixture was agitated for 15 minutes while the stirrer was rotated at a revolution of 400 rpm. As a result, a milky emulsion was prepared. Then the emulsion was heated for 5 hours at 75° C. to react the monomers.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid, hereinafter referred to as particulate resin dispersion (1)) was prepared.

The volume average particle diameter of the particles in the particulate resin dispersion (1), which was measured with an instrument LA-920 from Horiba Ltd., was 105 nm. In addition, part of the particulate resin dispersion (1) was dried to prepare a solid of the vinyl resin. It was confirmed that the vinyl resin has a glass transition temperature of 59° C. and a weight average molecular weight of 150,000.

Preparation of Aqueous Phase Liquid

Manufacturing Example 2

In a reaction vessel equipped with a stirrer, 990 parts of water, 83 parts of the particulate resin dispersion 1 prepared above, 37 parts of an aqueous solution of a sodium salt of dodecyldiphenyletherdisulfonic acid (ELEMINOL MON-7 from Sanyo Chemical Industries Ltd., solid content of 48.5%), and 90 parts of ethyl acetate were mixed while agitated. As a result, a milky liquid (hereinafter referred to as an aqueous phase liquid 1) was prepared.

Preparation of Unmodified Polyester Resin

Manufacturing Example 3

The following components were contained in a reaction container equipped with a condenser, a stirrer and a nitrogen feed pipe to perform a polycondensation reaction for 8 hours at 230° C. under a normal pressure.

| | |
|---|---|
| Ethylene oxide (2 mole) adduct of bisphenol A | 229 parts |
| Propylene oxide (3 mole) adduct of bisphenol A | 529 parts |
| Terephthalic acid | 208 parts |
| Adipic acid | 46 parts |
| Dibutyltin oxide | 2 parts |

Then the reaction was further continued for 5 hours under a reduced pressure of from 10 to 15 mmHg.

Further, 44 parts of trimellitic anhydride were fed into the container to be reacted with the reaction product for 2 hours at 180° C. Thus, an unmodified polyester resin 1 was prepared. The unmodified polyester resin 1 has a number average molecular weight of 2500, a weight average molecular weight of 6700, a glass transition temperature (Tg) of 43° C. and an acid value of 25 mgKOH/g.

Synthesis of Intermediate Polyester

Manufacturing Example 4

The following components were contained in a reaction vessel equipped with a condenser, a stirrer and a nitrogen feed pipe and reacted for 8 hours at 230° C. under a normal pressure.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyl tin oxide | 2 parts |

Then the reaction was further continued for 5 hours under a reduced pressure of from 10 to 15 mmHg. Thus, an intermediate polyester resin 1 was prepared. The intermediate polyester 1 has a number average molecular weight of 2100, a weight average molecular weight of 9500, a glass transition temperature (Tg) of 55° C., an acid value of 0.5 mgKOH/g and a hydroxyl value of 51 mgKOH/g.

In a reaction vessel equipped with a condenser, a stirrer and a nitrogen feed pipe, 410 parts of the intermediate polyester resin 1, 89 parts of isophorone diisocyanate and 500 parts of ethyl acetate were mixed and the mixture was heated at 100° C. for 5 hours to perform a reaction. Thus, a polyester prepolymer 1 having an isocyanate group was prepared. The content of free isocyanate included in the polyester prepolymer 1 was 1.53% by weight.

Synthesis of Ketimine Compound

Manufacturing Example 5

In a reaction vessel equipped with a stirrer and a thermometer, 170 parts of isophorone diamine and 75 parts of methyl ethyl ketone were mixed and reacted for 5 hours at 50° C. to prepare a ketimine compound. The ketimine compound has an amine value of 418 mgKOH/g.

Preparation of Master Batch

Manufacturing Example 6

The following components were mixed using a HENSCHEL MIXER from Mitsui Mining Co., Ltd.

| | |
|---|---|
| Water | 1200 parts |
| C.I. Pigment Red 269 (from Dainippon Ink & Chemicals, Inc.) | 540 parts |
| Polymer dispersant (EFKA-4080 from EFKA Chemical Co., having an amine value of from 3.6 to 4.1 mgKOH/g) | 108 parts |
| Polyester resin | 1200 parts |

The mixture was kneaded for 30 minutes at 150° C. using a two roll mill. Then the kneaded mixture was cooled by rolling, followed by pulverizing. Thus, a master batch 1 was prepared.

Preparation of Oil Phase Liquid

Manufacturing Example 7

In a reaction vessel equipped with a stirrer and a thermometer, 378 parts of the unmodified polyester resin 1, 110 parts of carnauba wax, 22 parts of a charge controlling agent (salicylic acid metal complex E-84 from Orient Chemical Co., Ltd.), and 947 parts of ethyl acetate were mixed and the mixture was heated to 80° C. while agitated. After the mixture was heated for 5 hours at 80° C., the mixture was cooled to 30° C. over 1 hour. Then 500 parts of the master batch 1 and 500 parts of ethyl acetate were added to the vessel, and the mixture was agitated for 1 hour to prepare a raw material dispersion 1.

Then 1,324 parts of the raw material dispersion 1 was subjected to a dispersion treatment using a bead mill (ULTRAVISCOMILL from Aimex Co., Ltd.). The dispersing conditions were as follows.

Liquid feeding speed: 1 kg/hour
Peripheral speed of disc: 6 m/sec
Dispersion media: zirconia beads with a diameter of 0.5 mm
Filling factor of beads: 80% by volume
Repeat number of dispersing operation: 3 times (3 passes)

Then 1,324 parts of a 65% ethyl acetate solution of the unmodified polyester resin 1 prepared above was added thereto. The mixture was subjected to the dispersion treatment using the bead mill. The dispersion conditions are the same as those mentioned above except that the dispersion operation was performed once (i.e., one pass).

The thus prepared colorant/wax dispersion (1) had a solid content of 50% when it was determined by heating the liquid at 130° C. for 30 minutes.

Preparation of Microcapsule

Manufacturing Example 8

At first, 40 parts of a 3.0% aqueous solution of gum arabic, which had been heated to 40° C., was added to 40 parts of a 3.0% aqueous solution of gelatin, which had also been heated to 40° C. Further, a 10% aqueous solution of acetic acid was added to the mixture to control the pH thereof at 4.5. Thus, a complex coacervate was formed. Then 20 parts of a 6.0% solution of cobalt naphthenate in which cobalt naphthenate is dissolved in a solvent (ISOPAR M from Exxon Mobil Chemical) was added thereto. The mixture was agitated using a HOMOMIXER which was rotated at a revolution of 4,500 rpm. After being cooled while agitated, the mixture was agitated for 1 hour at 8° C. Thus, the drops of the complex coacervate gelated. Then cool propyl alcohol, whose weight is the same as that of the dispersion, was added thereto to deposit and dehydrate the complex coacervate. After being allowed to settle, the dispersion was subjected to decantation to obtain the product. Then the product was dried at room temperature. Thus, a microencapsulated fatty acid metal salt 1 was prepared.

Synthesis of Crystalline Polyester Resin

Manufacturing Example 9

The following components were contained in a 5-liter four-necked flask equipped with a nitrogen feed pipe, a dewatering conduit, a stirrer and a thermocouple.

| | |
|---|---|
| 1,4-butanediol | 25 moles |
| Fumaric acid | 23.75 moles |
| Trimellitic anhydride | 1.65 moles |
| Hydroquinone | 5.3 g |

The mixture was heated at 160° C. to react the components. Then the temperature of the reaction product was raised to 200° C. and the reaction was further performed for 1 hour. Furthermore, the reaction was performed for 1 hour under a pressure of 8.3 Kpa. Thus, a crystalline polyester resin 1 was prepared. It was confirmed that the crystalline polyester resin has a melting point of 119° C., a number average molecular weight of 710, a weight average molecular weight of 2,100, an acid value of 24 mgKOH/g and a hydroxyl value of 28 mgKOH/g.

Preparation of Dispersion of Crystalline Polyester Resin

Manufacturing Example 10

One hundred grams of the crystalline polyester resin 1 and 400 g of ethyl acetate were contained in a 2-liter metal container. The mixture was heated to 79° C. to dissolve the resin 1. Then the solution was rapidly cooled in ice water to prepare a dispersion. Then the dispersion was subjected to a dispersion treatment using a batch sand mill while 500 ml of glass beads having a particle diameter of 3 mm were added to the metal container. Thus a dispersion of the crystalline polyester resin 1, which has a volume average particle diameter of 0.4 μ, was prepared.

Emulsification and Solvent Removal

Example 1

Then the following components were mixed in a container.

| | |
|---|---|
| Colorant/wax dispersion (1) prepared above | 664 parts |
| Prepolymer (1) prepared above | 109.4 parts |
| Dispersion of the crystalline polyester resin 1 | 73.9 parts |
| Ketimine compound (1) prepared above | 4.6 parts |

The components were mixed for 1 minute using a TK HOMOMIXER from Tokushu Kika Kogyo K.K., which was rotated at a revolution of 5,000 rpm. Thus, an oil phase liquid (1) (i.e., a toner composition liquid) was prepared.

In a container, 1,200 parts of the aqueous phase liquid 1 and 851.9 parts of the oil phase liquid 1 prepared above were mixed and the mixture was mixed for 20 minutes using TK HOMOMIXER, which was rotated at a revolution of 13,000 rpm. Thus, an emulsion 1 was prepared.

The emulsion 1 was fed into a container equipped with a stirrer and a thermometer, and the emulsion was heated for 8 hours at 30° C. to remove the organic solvent (ethyl acetate) from the emulsion. Then the emulsion was aged for 4 minutes at 45° C. Thus, a dispersion 1 was prepared.

Washing and Drying

One hundred (100) parts of the dispersion 1 were filtered under a reduced pressure.

Then the wet cake was mixed with 100 parts of ion-exchange water and the mixture was agitated for 10 minutes with a TK HOMOMIXER, which was rotated at a revolution of 12,000 rpm, followed by filtering. Thus, a wet cake (a) was prepared.

The thus prepared wet cake (a) was mixed with 100 parts of a 10% sodium hydroxide and the mixture was agitated for 30 minutes with a TK HOMOMIXER, which was rotated at a revolution of 12,000 rpm, followed by filtering under a reduced pressure. Thus, a wet cake (b) was prepared.

The thus prepared wet cake (a) was mixed with 100 parts of a 10% hydrochloric acid and the mixture was agitated for 10 minutes with a TK HOMOMIXER, which was rotated at a revolution of 12,000 rpm, followed by filtering. Thus, a wet cake (c) was prepared.

Then the wet cake (c) was mixed with 300 parts of ion-exchange water and the mixture was agitated for 10 minutes with a TK HOMOMIXER, which was rotated at a revolution of 12,000 rpm, followed by filtering. This operation was repeated twice. Thus, a wet cake (1) was prepared.

The wet cake (1) was dried for 48 hours at 45° C. using a circulating air drier, followed by sieving with a screen having openings of 75 μm. Then the microencapsulated fatty acid metal salt 1 was added to the thus prepared powder.

Thus, toner particles 1 were prepared.

Examples 2 to 6

The procedure for preparation of the toner in Example 1 was repeated except that the weight ratio of the prepolymer/unmodified polyester resin/crystalline polyester resin was changed as shown in Table 1 while the added amounts of the polyester prepolymer 1 (109.4 parts) and the ketimine compounds (4.6 parts) were not changed. Thus, toner particles 2 to 6 were prepared.

TABLE 1

| Example | Toner Particles | Prepolymer | Unmodified polyester | Crystalline polyester |
|---|---|---|---|---|
| 2 | 2 | 5 | 90 | 5 |
| 3 | 3 | 10 | 70 | 20 |
| 4 | 4 | 15 | 60 | 25 |
| 5 | 5 | 20 | 50 | 30 |
| 6 | 6 | 25 | 40 | 35 |

Comparative Example 1

The procedure for preparation of the toner in Example 1 was repeated except that the crystalline polyester dispersion 1 was not added.

Thus, toner particles 7 were prepared.

Comparative Example 1

The procedure for preparation of the toner in Example 1 was repeated except that the microencapsulated fatty acid metal salt 1 was not added.

Thus, toner particles 8 were prepared.

Comparative Example 1

The procedure for preparation of the toner in Example 1 was repeated except that the crystalline polyester dispersion 1 and the microencapsulated fatty acid metal salt 1 were not added.

Thus, toner particles 9 were prepared.

One hundred (100) parts of each of the thus prepared toner particles 1 to 9 was mixed with 0.7 parts of a hydrophobized silica and 0.3 parts of a hydrophobized titanium oxide using a HENSCHEL MIXER. Thus toners 1 to 9 were prepared. The properties of the toners 1 to 9 are shown in Table 2.

Then 5 parts of each toner was mixed with 95 parts of a carrier which is a particulate copper-zinc ferrite having an average particle diameter of 40 μm and coated with a silicone resin to prepare developers 1 to 9.

The toners 1 to 9 and the developers 1 to 9 were evaluated as: follows.

(a) Volume Average Particle Diameter (Dv), Number Average Particle Diameter (Dn) and Ratio (Dv/Dn) of Toner The average particle diameters Dv and Dn of each toner were determined using a particle diameter measuring instrument COULTER COUNTER TAII from Beckman Coulter. The aperture is 100 μm.

(b) Thermal Properties (Softening Point (Ts) and Flow Start Point (Tfb))

The thermal properties of each toner were measured using a flow tester CFT500 from Shimadzu Corp. The measurement conditions are as follows.

Load: 10 kg/cm$^2$

Temperature rising speed: 3.0° C./min

Diameter of die: 0.50 mm

Length of die: 10.0 mm

The softening point (Ts) and the flow starting point (Tfb) are defined as the points (Ts) and (Tfb) in the figure.

(c) Fixability (Tmax and Tmin)

Each developer was set in a color copier IMAGIO NEO 450 from Ricoh Co., Ltd. which is modified so as to have a belt fixing device, and solid toner images having a weight of 1.0±0.1 mg/cm$^2$ were formed on sheets of a paper TYPE 6200 from Ricoh Co., Ltd., and sheets of a copy and print paper <135> while changing the temperature of the fixing belt, to determine the maximum fixable temperature (Tmax) and the minimum fixable temperature (Tmin) of each toner.

The maximum fixable temperature (Tmax) was determined as follows.

1) the fixed images were carefully observed to determine whether a hot offset problem occurs.

The maximum fixable temperature (Tmax) is defined as a fixing temperature above which a hot offset phenomenon is observed in the fixed images.

The minimum fixable temperature (Tmin) was determined as follows.

1) the toner images fixed at different fixing temperatures were rubbed with a pad; and 2) the image densities of the images were measured before and after the rubbing to determine the fixing rate (FR):

$$FR=\{(ID2)/(ID1)\}\times 100(\%)$$

wherein ID1 represents the image density before rubbing and ID2 represents the image density after rubbing.

The minimum fixable temperature is defined as a fixing temperature below which the fixed image has a fixing rate less than 70%.

(d) Image Density (ID)

Each developer was set in a color copier IMAGIO NEO 450 from Ricoh Co., Ltd. which is modified so as to have a belt fixing device, and 100,000 images were continuously produced. A solid image was formed on a receiving paper TYPE 6200 from Ricoh Co., Ltd., at the beginning of the running test and after the 10,000$^{th}$ image and the 100,000$^{th}$ image. The image density of the images was measured with a densitometer X-RITE 938 from X-Rite.

(e) Background Development

Each developer was set in a color copier IMAGIO NEO 450 from Ricoh Co., Ltd. which is modified so as to have a belt fixing device, and a white image was formed. In the process of developing an electrostatic latent image formed on the photoreceptor, which corresponds to a white solid image, the developing operation was suddenly stopped. The toner particles present on a developed area of the photoreceptor were transferred to an adhesive tape. The adhesive tape bearing the toner particles thereon was set on a white paper. Then the density of the adhesive tape bearing the toner particles and the density of the virgin adhesive tape also set on the white paper were measured with a densitometer X-RITE 938 from X-Rite.

(f) Contamination of Cleaning Roller (CONT)

The cleaning roller of the color copier was visually observed after the 100,000-sheet running test to determine whether the cleaning roller is contaminated with toner particles. The contamination of the cleaning roller is graded as follows.

◎: The cleaning roller is hardly contaminated. (Excellent)

○: The cleaning roller is slightly contaminated. (Good)

Δ: The cleaning roller is considerably contaminated.

X: The cleaning roller is seriously contaminated. (Bad)

(g) Toner Filming (FILM)

The surfaces of the developing roller and the photoreceptor of the copier were visually observed to determine whether a toner film is formed thereon. The filming is graded as follows.

○: No toner film is formed thereon. (Good)

Δ: Streak-like toner films are formed thereon.

X: A film is formed on the entire surfaces of the photoreceptor and the developing roller. (Bad)

(h) High Temperature Preservability (PS)

The high temperature preservability of each toner was evaluated by the following penetration method. The procedure is as follows.

1) a toner is contained in a 50 ml container and the container is tapped 50 times;

2) the container is allowed to settle for 24 hours in a chamber heated to 50° C.;

3) the toner in the container is cooled to room temperature; and 4) the toner is subjected to a penetration test in which a needle is penetrated into the toner layer at a predetermined pressure and the length of the part of the needle penetrated into the toner layer is measured.

The high temperature preservability is graded as follows:

◎: The entire toner layer is penetrated by the needle.

○: The penetration length is not less than 25 mm.

□: The penetration length is not less than 20 mm and less than 25 mm.

Δ: The penetration length is not less than 15 mm and less than 20 mm.

X: The penetration length is less than 25 mm.

(i) Hot Offset Resistance (HOT)

The hot offset resistance of the toners are graded as follows.

◎: The hot offset temperature is not lower than 220° C.

○: The hot offset temperature is lower than 220° C. and not lower than 200° C.

Δ: The hot offset temperature is lower than 200° C. and not lower than 180° C.

X: The hot offset temperature is lower than 180° C.

The evaluation results are shown in Tables 2 and 3.

TABLE 2

| Toner | Particle diameter | | | Thermal properties | | Fixability | |
|---|---|---|---|---|---|---|---|
| No. | Dv(μm) | Dn(μm) | Dv/Dn | Ts(° C.) | Tfb(° C.) | T(min) (° C.) | T(max) (° C.) |
| 1 | 4.52 | 4.13 | 1.09 | 61 | 95 | 125 | ≧220 |
| 2 | 5.23 | 4.65 | 1.12 | 62 | 96 | 125 | ≧220 |
| 3 | 4.38 | 4.01 | 1.09 | 57 | 90 | 120 | ≧220 |
| 4 | 4.92 | 4.48 | 1.10 | 56 | 88 | 120 | ≧220 |
| 5 | 5.51 | 4.89 | 1.13 | 55 | 87 | 115 | ≧220 |
| 6 | 5.16 | 4.64 | 1.11 | 55 | 88 | 115 | ≧220 |
| 7 | 4.89 | 4.19 | 1.17 | 64 | 115 | 150 | 200 |
| 8 | 5.44 | 4.88 | 1.11 | 57 | 96 | 130 | 180 |
| 9 | 5.22 | 4.66 | 1.12 | 65 | 117 | 155 | 200 |

TABLE 3

| Toner No. | Image density | | | Background development | | | CONT | FILM | PS | HOT |
|---|---|---|---|---|---|---|---|---|---|---|
| | Start | $10^4$ | $10^5$ | Start | $10^4$ | $10^5$ | | | | |
| 1 | 1.39 | 1.40 | 1.39 | 0.00 | 0.00 | 0.00 | ◎ | ○ | ○ | ◎ |
| 2 | 1.42 | 1.40 | 1.41 | 0.00 | 0.01 | 0.00 | ◎ | ○ | ○ | ◎ |
| 3 | 1.43 | 1.43 | 1.42 | 0.00 | 0.00 | 0.00 | ◎ | ○ | ○ | ◎ |
| 4 | 1.41 | 1.42 | 1.41 | 0.00 | 0.00 | 0.01 | ◎ | ○ | ○ | ◎ |
| 5 | 1.39 | 1.41 | 1.40 | 0.01 | 0.01 | 0.00 | ◎ | ○ | ○ | ◎ |
| 6 | 1.42 | 1.41 | 1.41 | 0.00 | 0.00 | 0.00 | ◎ | ○ | ○ | ◎ |
| 7 | 1.43 | 1.37 | 1.33 | 0.01 | 0.02 | 0.03 | Δ | ○ | ○ | ○-Δ |
| 8 | 1.41 | 1.39 | 1.36 | 0.01 | 0.13 | 0.36 | X | X | X | Δ-X |
| 9 | 1.40 | 1.37 | 1.34 | 0.01 | 0.02 | 0.02 | Δ | ○ | ○ | ○-Δ |

Note:
Start: at the start of the running test
$10^4$: after 10,000 images
$10^5$: after 100,000 images It is clear from Tables 2 and 3 that the toner of the present invention has a good combination of low temperature fixability, offset resistance and high temperature preservability and produce high quality images for a long period of time without contaminating image forming members such as developing roller.

This document claims priority and contains subject matter related to Japanese Patent Application No. 2004-248000, filed on Aug. 27, 2004, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a binder resin comprising a polyester resin in an amount of from 50 to 100% by weight, wherein the polyester resin comprises an unsaturated polyester resin;

a colorant; and a fatty acid metal salt which is microencapsulated with at least one resin that acts to avoid acceleration of an oxidation reaction of double bonds of the unsaturated polyester resin by the fatty acid metal salt prior to heating the toner.

2. The toner according to claim 1, wherein the fatty acid metal salt serves to accelerate oxidation polymerization of double bonds of the unsaturated polyester resin when the toner is heated.

3. The toner according to claim 1, wherein the unsaturated polyester resin is a crystalline polyester resin (iii).

4. The toner according to claim 3, wherein the crystalline polyester resin (iii) has a melting point (T(F1/2)) of from 65 to 140° C. and a glass transition temperature (Tg) of from 65 to 140° C.

5. The toner according to claim 3, wherein the crystalline polyester resin (iii) has a molecular weight distribution such that o-dichlorobenze-soluble components of the crystalline polyester have a weight average molecular weight (Mw) of from 1,000 to 30,000, a number average molecular weight (Mn) of from 500 to 6,000 and a ratio (Mw/Mn) of from 2 to 8, which are determined by gel permeation chromatography.

6. The toner according to claim 3, wherein the crystalline polyester resin (iii) has an infrared absorption spectrum such that an absorption peak due to δCH (out-of-plane angle-changing vibration) of an olefin is observed at 965±10 $cm^{-1}$ or 990±10 $cm^{-1}$.

7. The toner according to claim 3, wherein the crystalline polyester resin (iii) has the following formula (1):

$$[—O—CO—(CR_l{=}CR_2)_L—CO—O—(CH_2)_n—]_m \quad (1),$$

wherein each of n and m is a repeat number and is a positive integer; L is an integer of from 1 to 3; and each of R1 and R2 represents a hydrogen atom, or a hydrocarbon group.

8. The toner according to claim 3, wherein the crystalline polyester resin (iii) has a unit obtained from a diol compound having from 2 to 6 carbon atoms and a unit obtained from an acid compound selected from the group consisting of fumaric acid and derivatives thereof.

9. The toner according to claim 8, wherein the diol compound is a member selected from the group consisting of 1,4-butanediol, 1,6-hexanediol and derivatives thereof.

10. The toner according to claim 3, wherein the crystalline polyester resin (iii) has an acid value of from 5 to 45 mgKOH/g.

11. The toner according to claim 3, wherein the crystalline polyester resin (iii) has a hydroxyl value of from 5 to 50 mgKOH/g.

12. The toner according to claim 3, wherein the polyester resin further comprises a modified polyester resin (i) and an unmodified polyester resin (ii), wherein a weight ratio (i/(ii)+(iii)) of the polyester resin (i) to total of the polyester resin (ii) and the polyester resin (iii) is from 5/95 to 25/75 and a weight ratio (ii)/(iii) of the polyester resin (ii) to the polyester resin (iii) is from 99/1 to 50/50.

13. The toner according to claim 12, wherein each of the modified polyester resin (i) and the unmodified polyester resin (ii) has an acid value of from 0.5 to 30 mgKOH/g.

14. The toner according to claim 12, wherein the unmodified polyester resin (ii) has a glass transition temperature of from 30 to 70° C.

15. The toner according to claim 1, further comprising a release agent.

16. The toner according to claim 15, wherein the release agent is included in the toner in an amount of from 1 to 50 parts by weight per 100 parts by weight of the toner.

17. The toner according to claim 15, wherein the release agent has a melting point of from 50 to 120° C.

18. A developer comprising:

the toner according to claim 1; and a carrier.

19. A method for preparing a toner comprising:

forming particles of a toner composition comprising at least a binder resin including a polyester resin in an amount of from 50 to 100% by weight and a colorant, in an aqueous medium to prepare a dispersion of a particulate material, wherein the polyester resin includes an unsaturated polyester resin;

drying the particulate material; and mixing a fatty acid metal salt which is microencapsulated with at least one resin with the particulate material to subject double bonds of the unsaturated polyester resin to oxidation polymerization, wherein said at least one resin acts to avoid acceleration of the oxidation reaction of double bonds of the unsaturated polyester resin by the fatty acid metal salt prior to heating the toner.

20. The method according to claim 19, wherein the particle forming step comprises:

dispersing or dissolving a colorant in a binder resin including a polyester resin having a group reactive with an active hydrogen atom to prepare a toner composition liquid;

dispersing the toner composition liquid in an aqueous medium; and polymerizing the polyester resin to prepare the particles of the toner composition.

21. The method according to claim 19, wherein the particle forming step comprises:

dispersing or dissolving a binder resin and a colorant in an organic solvent to prepare a toner composition liquid;

dispersing the toner composition liquid in an aqueous medium to prepare an emulsion; and removing the organic solvent from the emulsion to prepare a dispersion of a particulate material.

22. The method according to claim 21, wherein a weight ratio of the colorant to the organic solvent is from 5/95 to 50/50.

23. The method according to claim 19, wherein the particle forming step comprises:

dispersing or dissolving at least a polymer having a group reactive with an active hydrogen atom, a colorant and a release agent in an organic solvent to prepare a toner composition liquid;

dispersing the toner composition liquid in an aqueous medium to prepare an emulsion;

removing the organic solvent from the emulsion after or while reacting the polymer with a compound having an active hydrogen atom to prepare a particulate material; and washing the particulate material.

24. The method according to claim 23, wherein the first mentioned dispersing step comprises:

dispersing or dissolving at least a modified polyester resin (i) having a group reactive with an active hydrogen atom, an unmodified polyester resin (ii), a crystalline polyester resin (iii), a colorant and a release agent in an organic solvent to prepare a toner composition liquid, wherein the weight ratio (i)/(ii)+(iii)) of the weight of the resin (i) to the total weight of the resins (ii) and (iii) is from 5/95 to 25/75 and wherein the weight ratio ((ii)/(iii)) of the resin (ii) to the resin (iii) is from 99/1 to 50/50.

25. The method according to claim 24, wherein each of the modified polyester resin (i) and the unmodified polyester resin (ii) has an acid value of from 0.5 to 30 mgKOH/g.

26. The method according to claim 19, wherein the aqueous medium comprises a particulate resin having an average particle diameter of from 5 to 500 nm.

27. The method according to claim 19, wherein the unsaturated polyester resin is a crystalline polyester resin.

* * * * *